US007086548B2

(12) United States Patent
Bartlett

(10) Patent No.: US 7,086,548 B2
(45) Date of Patent: Aug. 8, 2006

(54) MOLDED CONTAINER WITH ANTI-GLUG VENT TUBE AND PINCHED HANDLE

(75) Inventor: Glenn Bartlett, Winnipeg (CA)

(73) Assignee: Reliance Products Limited Partnership, Manitoba (CA)

( * ) Notice: Subject to any disclaimer, the term of this patent is extended or adjusted under 35 U.S.C. 154(b) by 0 days.

(21) Appl. No.: 10/423,048

(22) Filed: Apr. 25, 2003

(65) Prior Publication Data

US 2004/0211748 A1 Oct. 28, 2004

(51) Int. Cl.
*B65D 23/10* (2006.01)
*B65D 1/18* (2006.01)

(52) U.S. Cl. ..... 215/398; 215/902; 220/745; 220/771; 222/465.1; 222/468

(58) Field of Classification Search ..... 215/398, 215/902; 220/745, 771; 222/465.1, 468, 222/479, 481.5, 475
See application file for complete search history.

(56) References Cited

U.S. PATENT DOCUMENTS 308,106 A * 11/1884 Stimpson ..... 222/468
1,115,405 A * 10/1914 Davis ..... 222/479
3,066,819 A * 12/1962 Cox ..... 215/44
3,069,039 A * 12/1962 Stickney ..... 215/44
3,198,367 A * 8/1965 Stickney ..... 215/40
4,055,282 A * 10/1977 Komendowski ..... 222/421
4,412,633 A * 11/1983 Guerrazzi et al. ..... 222/468
4,838,464 A * 6/1989 Briggs ..... 222/478
5,340,000 A * 8/1994 Ring ..... 222/468
5,346,106 A 9/1994 Ring
5,538,165 A * 7/1996 Frohn ..... 222/479
6,029,858 A * 2/2000 Srokose et al. ..... 222/143
6,360,924 B1 * 3/2002 Franzen ..... 222/468
6,460,741 B1 * 10/2002 Ho ..... 222/482

* cited by examiner

*Primary Examiner*—Sue A. Weaver
(74) *Attorney, Agent, or Firm*—Adrian D. Battison; Michael R. Williams; Ryan W. Dupuis

(57) ABSTRACT

A blow molded container has a planar pinched section formed between and connecting a top wall, a neck and a front handle end of the container with an anti-glug vent tube formed in the planar pinched section so as to extend through the pinched section and spaced by parts of the planar pinched section away from the neck, from the front handle end and from the top wall. The vent tube is substantially horizontal at the neck breaking through a vertical wall of the neck and has the other end breaking out through the top wall at the bottom of the downwardly extending section between the neck and the front handle end.

3 Claims, 5 Drawing Sheets

MOLDED CONTAINER WITH ANTI-GLUG VENT TUBE AND PINCHED HANDLE

This invention relates to a blow molded container or bottle, of the type having a pinched handle, which incorporates an anti-glug vent tube extending from the pouring neck or spout back to the container to release air back into the hollow interior to replace the liquid exiting from the container through the neck.

BACKGROUND OF THE INVENTION

The manufacture of plastics bottles or containers by blow moulding is well known. Many such containers are of a type having a main container body defined by a base, four upstanding side walls from the base and a top thus defining a hollow interior for containing a liquid or fluid material to be dispensed. The top wall in many cases defines a neck which is often threaded to receive a closure cap. A handle is also formed at or above the top wall and alongside the neck allowing the container to be lifted manually for pouring the contents through the neck.

In some cases the neck is arranged adjacent one side wall so as to accommodate the handle extending from the neck toward the opposite side wall. However the neck can be located more centrally. In many cases the neck is tapered from the top wall upwardly toward a ring or collar at which the threaded section is provided.

Many containers or bottles of this type are designed for no-glug pouring action so that the liquid can flow smoothly out of the container or bottle while a path is provided for air the flow back into the bottle. Many different designs for providing such a path are available. The present invention is concerned with arrangements in which the path is provided between the neck and the interior of the bottle so that the path also is closed when the neck is capped.

A primary technique for providing such a no-glug action is to provide a path through the handle so that the handle connects to the neck at one end and the handle connects to the interior of the container at the other end. In order to ensure a path of the air back through the open top of the neck, there is provided a restricting orifice in the neck at a position below the connection to the neck of the handle so that the liquid flow is limited to the dimensions of the restrictive orifice and is confined to the side of the neck opposite to the handle thus leaving an area of the mouth of the neck at the handle which is available for the back flow of air through the mouth, through the handle to the interior of the container.

However this design of bottle requires a hollow handle which provides a path through the handle form the neck to the interior of the container. Such hollow handles are undesirable in certain applications and the need of a pinched handle with an anti-glug action is desired. Such pinched type handles, even though they are more difficult to mold, have the advantage of not allowing the contents of the bottle to enter the handle. This is desired in some applications because the liquid may dry in the open handle leaving dried particles which can flake off and contaminate the liquid stored in the bottle.

In such pinched handles, the plastics tube which forms the container within the blow mould is pinched together at the bottom of the container to close the bottom and is also pinched together at the top of the container to form a pinched section at each end of the handle. The pinched section is thus formed from both walls of the tubular material which is brought together at the top of the container to form a pinched web or pinched portion on the centre line of the container having a thickness approximately double the thickness of the wall of the material. Thus there is a first pinched area between the front end of the handle at the neck, the top wall of the container and the neck thus separating the handle from the neck and from the top. Similarly a rear pinched section is provided between the rear of the handle and the top wall of the container. The handle itself is hollow so that it is moulded with the two sides of the material again separated within the handle. An area between the handle and the top wall of the container is removed to provide a hand grip section through which the fingers of the user can be inserted.

Up till now therefore there has been no design available of a bottle with a pinched type handle which can provide the path for the return air flow in a no-glug container.

However a proposal is shown in U.S. Pat. No. 5,346,106 (Ring) assigned to Ring Can Corporation and issued Sep. 13$^{th}$, 1994 which discloses a pinched type handle and also provides a tube which extends from the neck along the top wall of the container to an end of the tube at the rear wall of the container adjacent the rear end of the handle. The tube apparently forms a part of the upper wall and is moulded integrally with the upper wall. This product is apparently not available on the marketplace and the moulding of the tube as an integral part of the top wall is apparently difficult or impossible to achieve so that there has been no ability to commercially exploit this particular arrangement.

SUMMARY OF THE INVENTION

It is one object of the invention to provide an improved anti-glug container of the pinched handle type which uses a vent tube separate from the handle but which can be reliably and economically molded using conventional blow molding techniques.

According to one aspect of the invention there is provided a blow molded container comprising:

a bottom wall, side walls and a top wall enclosing a hollow interior;

a neck formed in the top wall and defining an opening through which liquid contained within the hollow interior can be poured for discharge from the container;

a handle formed at the top wall and having a front handle end adjacent the neck;

a planar pinched section formed between and connecting the top wall, the neck and the front handle end;

a vent tube having an air inlet mouth at the neck and an air outlet mouth at the top wall;

the neck having a restrictive orifice therein below the air inlet opening shaped and arranged such that, when liquid is poured from the container through the neck, the liquid is directed away from the air inlet opening to allow air to enter the air inlet opening to pass through the vent tube to the hollow interior without being restricted by the exiting liquid;

the vent tube being formed in the planar pinched section so as to extend through the pinched section and spaced by parts of the planar pinched section away from the neck, from the front handle end and from the top wall.

Preferably the vent tube includes an upper substantially horizontal portion which defines said air inlet mouth in a substantially vertical wall of the neck. Thus instead of the vent tube following along the vertical wall of the neck, it extends away from the neck toward the handle so as to be located generally between the neck and the handle rather than at the neck. In order to be readily molded, the vent tube has a substantial part of the planar pinched section between it and the neck and between it and the handle. The vent tube may be inclined slightly downwardly at its neck end.

Preferably the vent tube has a downwardly extending portion which is located between the neck and the front handle end and wherein the exit mouth is arranged at a bottom of the downwardly extending portion.

Preferably substantially the whole length of the vent tube is formed in the planar pinched section.

Preferably the handle includes a rear handle end connected to the top wall at a position spaced from the front handle end defining a part of the top wall which is spaced from the handle to form a handle opening therebetween and wherein the air exit mouth of the vent tube is located between the handle opening and the neck.

In this case the handle may be pinched at both ends so that there is a rear planar pinched section between the top wall and the rear handle end. However the handle may be open at its rear end connected to the hollow interior and pinched only at its front end.

In another arrangement where the handle includes a pinched rear handle end connected to the top wall, there is provided a pinched portion standing up as a web from the top wall. In this arrangement, the vent tube extends though the upstanding pinched portion to a mouth spaced from the front handle end, with the vent tube being separated within the upstanding pinched portion from the top wall by a part of the pinched portion.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
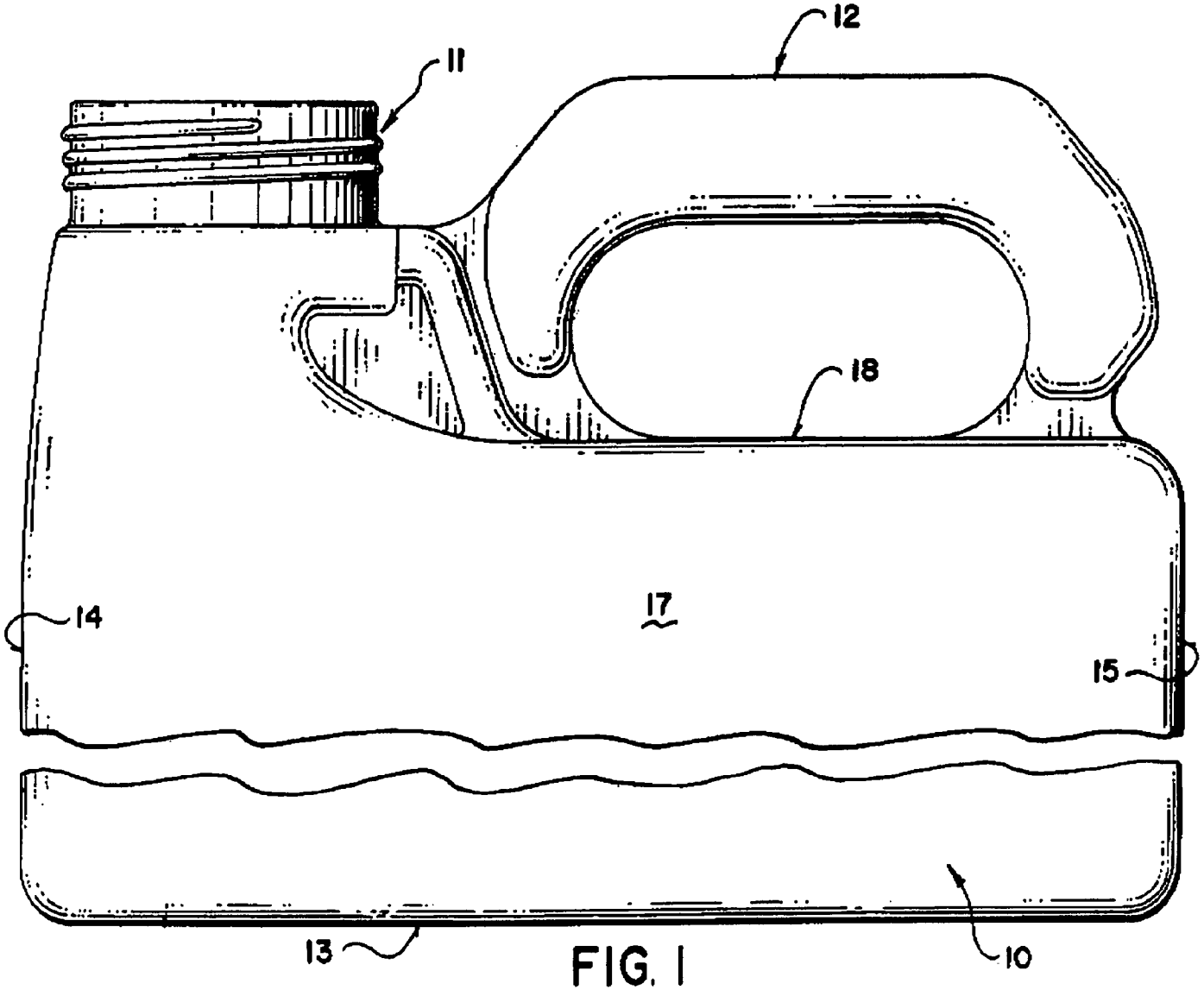
FIG. 1 is a side elevational view of a container according to the present invention.
Figure 2:
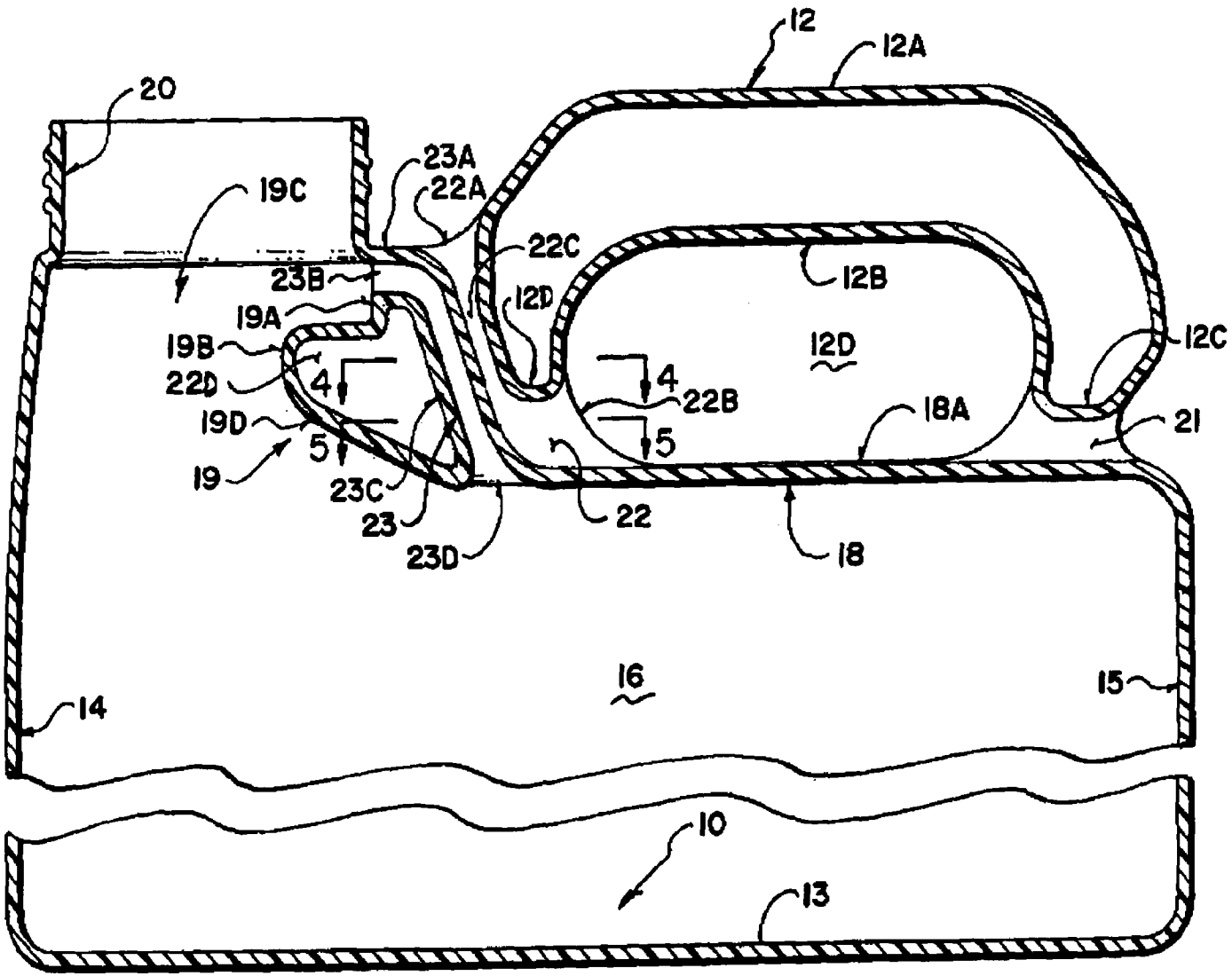
FIG. 2 is a vertical cross sectional view of the container of FIG. 1.

In the figures is shown a container or bottle which is formed by blow moulding using conventional blow moulding techniques to form a hollow interior of the container 10 having a neck 11 and a handle 12.

The container 10 has a bottom wall 13, a front wall 14, a rear wall 15, first side wall 16 and a second side wall 17. The container further has a top wall 18 which is shaped adjacent the front wall 14 to form a neck 19 which extends upwardly from a horizontal portion 18A of the top wall to a threaded collar 20 spaced upwardly from the horizontal portion 18A. The neck 19 in this arrangement is formed in association with the front wall 14. The collar 20 is threaded to receive a female threaded cap closing the neck and thus closing the whole of the container.

The handle 12 forms a hollow body with an upper wall 12A and a bottom wall 12B both of which include a horizontal section and both of which extend downwardly to form a front end 12D and a rear end 12C. Underneath the bottom wall 12B is provided a handle opening 12D which is open in the area between the bottom wall 12B and the top wall 18A so as to provide a generally elliptical opening through which the fingers of the user can be inserted for carrying the container by lifting the bottom wall 12B.

Between the rear end 12C of the handle and the top wall 18A is provided a rear pinched portion 21. The rear pinched portion lies of a centre line of the container and is formed by pinching the two sides of the plastics tube or insert to form a central web connecting the handle to the top wall and closing the top wall.

At the forward end of the handle is provided a front pinched portion 22 which acts to interconnect the top wall portion 18A, the front end 12D of the handle and the neck 19. Thus the forward pinched portion 22 has an upper edge 22A at the neck downwardly of the collar 20. Thus the pinched portion 22 has a rear edge 22B extending downwardly from the forward end of the handle and interconnecting with the top portion 18A. The rear edge 22B is smoothly curved to form part of the elliptical handle opening 12D.

The front pinched portion 22 is dimensioned and arranged so as to receive defined within it a vent tube 23. The vent tube is thus moulded within the pinched portion as a tubular duct defined within the pinched portion by a separation of the two walls of the pinched portion over the length of the duct. The forward end 12B of the handle is spaced from the neck 19 by a distance to allow the vent tube 23 to extend through that area and at the same time to be spaced both from the neck 19 and from the handle 12 by a section of the pinched portion. Thus on the front side of the vent tube 23 is defined a pinched portion 22D and on the rearward side of the vent tube is defined a pinched portion 22C.

At its upper end, the vent tube 23 has a generally horizontal section 23A which extends forwardly along the pinched portion 22 to a forward end 23B of the vent tube which defines a mouth breaking through a wall 19A of the neck. The wall 19A is substantially vertical at the mouth 23B. From the horizontal section 23A the vent tube is inclined downwardly and rearwardly in a main portion 23C which extends down between a inclined wall of the neck 19 and an inclined portion of the handle at its forward end. At the bottom end of the inclined portion 23C of the vent tube is provided a mouth 23D which breaks through the top wall 18A of the container. The mouth 23D of the vent tube is located, in the embodiment of FIG. 1, within the front pinched portion 22.

Figure 3:
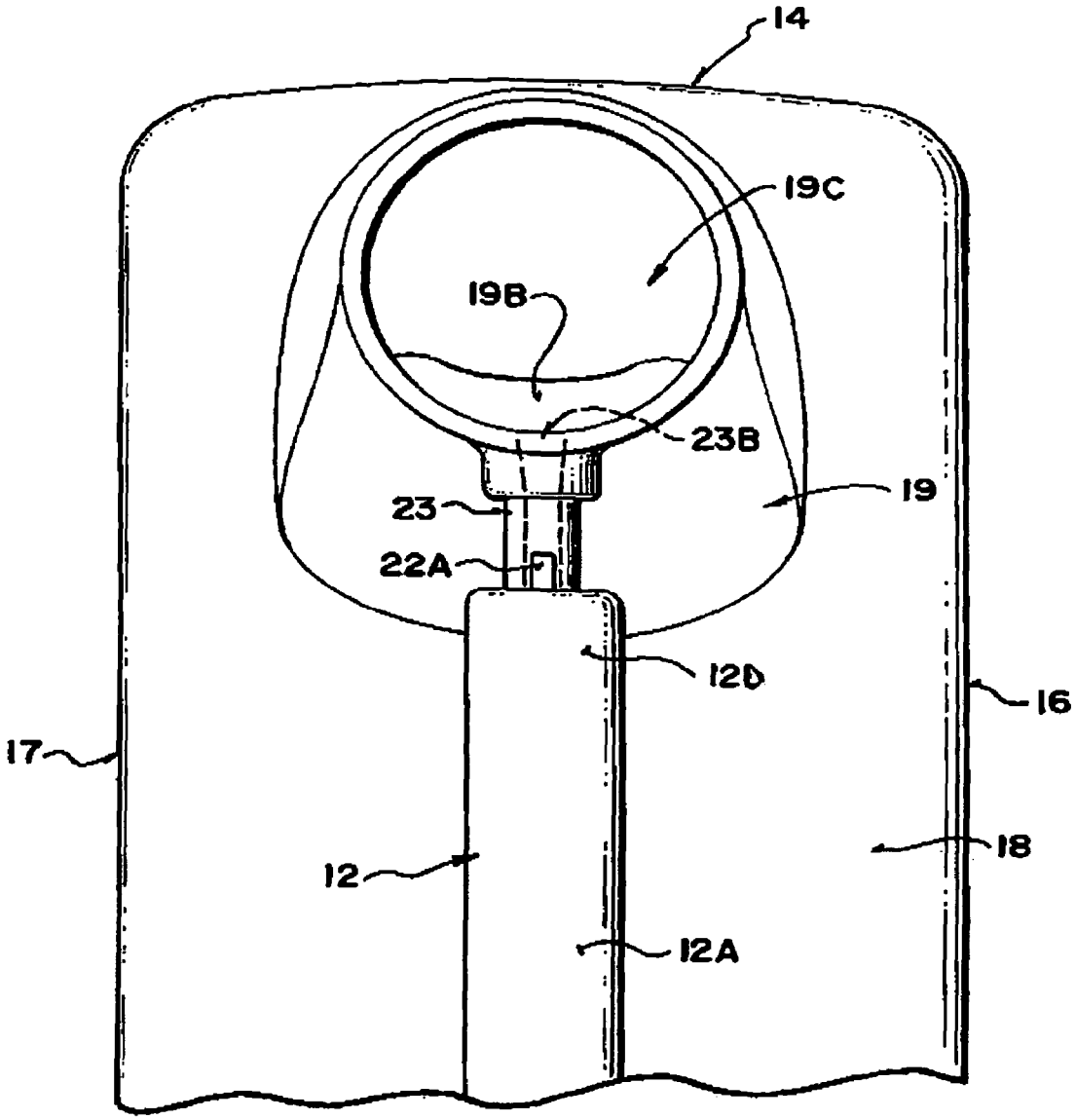
FIG. 3 is a top plan view of the container of FIG. 1.
Figure 4:
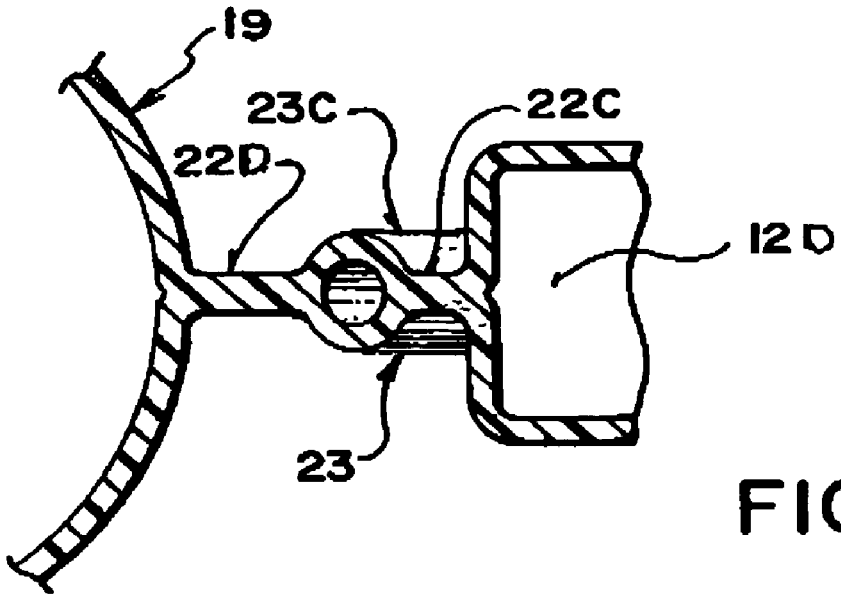
FIG. 4 is a cross sectional view of the container of FIG. 1 taken along the lines 4—4.
Figure 5:
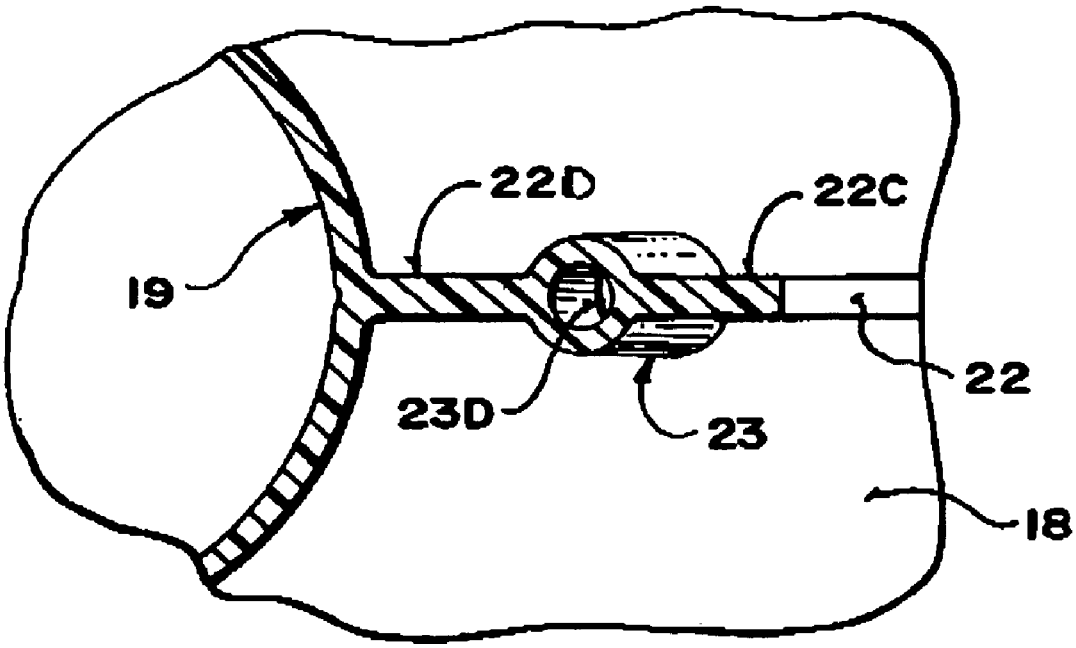
FIG. 5 is a cross sectional view of the container of FIG. 1 taken along the lines 5—5.

Within the neck 19 is provided a restricting wall 19B forming a restricting orifice 19C within the neck below the mouth 23B. The wall 19B extends around the rearward part of the neck so as to form the orifice 19C in the forward part of the neck adjacent the wall 14 as best shown in FIG. 3. The restricting wall is formed by reducing the size of the neck at the underside of the vent tube so that the top wall of the container interconnects with the neck by a wall portion 19D which undercuts the area of the vent tube.

The vent tube 23 is thus formed by moulding within the area of the pinched section so as to divide the two walls of the pinched section over the length of the duct so as to define a hollow conduit within the duct through which air can pass from the neck at a position just below the collar 20 and above the restricting orifice 19C. In this way the air enters the mouth of the collar and runs backwardly through the neck to the mouth 23B without interfering with or interference from the liquid flowing out of the neck in view of the restriction of that liquid by the restricting orifice 19C. The air can thus pass back through the vent tube to the mouth

23D which is located on the top surface 18 at the centre line within the pinched section 22. The tube thus breaks out from the pinched section through the open mouth in the top surface and allows the air to enter the container through the mouth 23D. If this mouth is below the level of the liquid during the pouring action, the air still enters into the container and bubbles through the liquid. However this bubbling action within the liquid does not interfere with the pouring of the liquid through the neck so that there is no glugging action of the liquid as it pours from the container.

The vent tube can be molded in the pinched portion using conventional molding techniques well known to one skilled in the art. As the vent tube is connected to the bottle and to the neck, it is inflated by the inflation gas pumped into the bottle in the molding process with the inflation of the bottle thus pressing the plastics material against the inside surface of the mold which defines the neck, bottle and vent tube.

Figure 6:
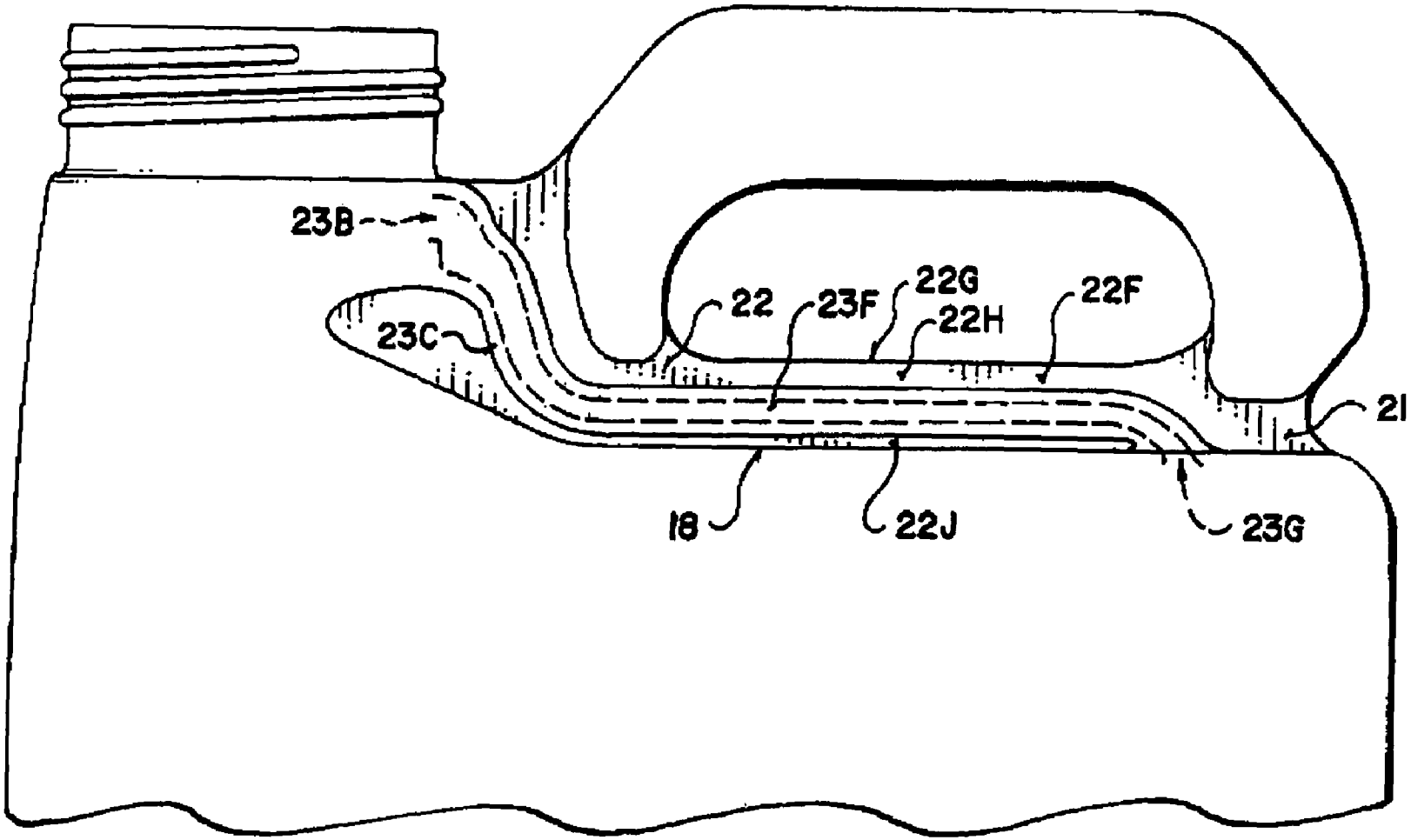
FIG. 6 is a side elevational view similar to that of FIG. 1 of a second embodiment of container according to the present invention.

Turning now to FIG. 6, there is shown an alternative arrangement in which the vent tube 23 has an extension portion 23F which extends from the bottom of the inclined portion 23C horizontally to a mouth 23G adjacent the rear of the bottle. In order to achieve this there is formed a pinched portion 22F interconnecting the pinched portions 21 and 22 and standing upward from the top wall 18 along the center line of the top wall. The vent tube portion 23F is spaced within the pinched portion 22F and thus is separated from a top edge 22G of the pinched portion by a part 22H of the pinched portion and more importantly is separated from the top wall 18 by a part 22J of the planar pinched portion. As shown the mouth 23G is located before the pinched portion 21 at the rear of the handle but it will be appreciated that the mouth may also extend into the pinched portion 21 provided the vent tube portion is along its whole length separated from the top wall by a planar part of the pinched portion.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A blow molded container comprising:

a bottom wall, side walls and a top wall enclosing a hollow interior;

a neck formed in the top wall and defining an opening through which liquid contained within the hollow interior can be poured for discharge from the container;

a handle formed at the top wall rearward of the neck and having a front handle end adjacent the neck and a handle opening underneath the handle and rearward of the front handle end;

a planar pinched section formed between and connecting the top wall, the neck and the front handle end;

a vent tube having an air inlet mouth at the neck and an air outlet mouth at the top wall;

the neck having a restrictive orifice therein below the air inlet mouth shaped and arranged such that, when liquid is poured from the container through the neck, the liquid is directed away from the air inlet mouth to allow air to enter the air inlet mouth to pass through the vent tube to the hollow interior without being restricted by the exiting liquid;

the vent tube being formed in the planar pinched section so as to extend through the pinched section and spaced by parts of the planar pinched section away from the neck from the front handle end and from the top wall;

the vent tube including an upper substantially horizontal portion which defines said air inlet mouth in a substantially vertical wall of the neck.

2. The container according to claim 1 wherein the vent tube has a downwardly extending portion which is located between the neck and the front handle end and wherein the air outlet mouth through the top wall is arranged at a bottom of the downwardly extending portion so as to be forward of the handle opening between the handle opening and the neck.

3. A blow molded container comprising:

a bottom wall, side walls and a top wall enclosing a hollow interior;

a neck formed in the top wall and defining an opening through which liquid contained within the hollow interior can be poured for discharge from the container;

a handle formed at the top wall rearward of the neck and having a front handle end adjacent the neck and a handle opening underneath the handle and rearward of the front handle end;

a planar pinched section formed between and connecting the top wall, the neck and the front handle end;

a vent tube having an air inlet mouth at the neck and an air outlet mouth at the top wall;

the neck having a restrictive orifice therein below the air inlet mouth shaped and arranged such that, when liquid is poured from the container through the neck, the liquid is directed away from the air inlet mouth to allow air to enter the air inlet mouth to pass through the vent tube to the hollow interior without being restricted by the exiting liquid;

the vent tube being formed in the planar pinched section so as to extend through the pinched section and spaced by parts of the planar pinched section away from the neck from the front handle end and from the top wall;

wherein the vent tube has a downwardly extending portion which is located between the neck and the front handle end and wherein the air outlet mouth through the top wall is arranged at a bottom of the downwardly extending portion so as to be forward of the handle opening between the handle opening and the neck.

* * * * *